US005146715A

United States Patent [19]

Bando

[11] Patent Number: 5,146,715

[45] Date of Patent: Sep. 15, 1992

[54] APPARATUS FOR GRINDING A PERIPHERAL EDGE OF A GLASS SHEET

[75] Inventor: Shigeru Bando, Tokushima, Japan

[73] Assignee: Bando Kiko Co., Ltd., Tokushima, Japan

[21] Appl. No.: 620,070

[22] Filed: Nov. 30, 1990

[30] Foreign Application Priority Data

Nov. 30, 1989 [JP] Japan ..... 1-312620

[51] Int. Cl.[5] ..... B24B 9/10

[52] U.S. Cl. ..... 51/165.77; 51/165.71; 51/165.9; 51/283 E

[58] Field of Search ..... 51/283 E, 165.77, 165.9, 51/165.8, 165.71, 165 R, 98 R, 99

[56] References Cited

U.S. PATENT DOCUMENTS

| | | | |
|---|---|---|---|
| 4,587,764 | 5/1986 | Leone et al. | 51/283 E |
| 4,633,408 | 12/1986 | Reinmold | 51/283 E |
| 4,756,124 | 7/1988 | Rossi | 51/283 E |

FOREIGN PATENT DOCUMENTS

| | | | |
|---|---|---|---|
| 0358029 | 3/1990 | European Pat. Off. | 51/165.71 |
| 0372832 | 6/1990 | European Pat. Off. | 51/165.9 |
| 2244348 | 4/1974 | Fed. Rep. of Germany . | |
| 2587260 | 3/1987 | France . | |
| 54-117992 | 9/1979 | Japan . | |
| 55-25024 | 7/1980 | Japan . | |
| 56-114655 | 9/1981 | Japan . | |
| 59-37040 | 2/1984 | Japan . | |
| 59-47152 | 3/1984 | Japan . | |
| 62-246463 | 10/1987 | Japan . | |
| 63-84861 | 4/1988 | Japan . | |

*Primary Examiner*—Roberta Rose
*Attorney, Agent, or Firm*—Cushman, Darby & Cushman

[57] ABSTRACT

A numerical control apparatus for grinding a peripheral edge of a glass sheet, comprises a grinding head having a grinding wheel which is supported in an air-floating manner by an air cylinder and subjected to angularly rotating control so that the grinding wheel is brought into contact with the peripheral edge of the glass sheet, and a brake means for restricting an air-floating movement of the grinding wheel.

4 Claims, 6 Drawing Sheets

APPARATUS FOR GRINDING A PERIPHERAL EDGE OF A GLASS SHEET

FIELD OF THE INVENTION

This invention relates to a grinding apparatus for grinding, abrading, pencil-edging or seaming a peripheral edge of the glass sheet by moving and angularly controlling a grinding wheel by means of a numerical control system.

Further, the present invention relates to a grinding apparatus suitable for conducting a pencil-edging or seaming of the edge of the glass sheet or plate which is used as automobile glass such as windshield, a rear window glass and a side window glass.

More particularly, this invention is concerned with an improvement of an apparatus for grinding a glass sheet, which comprises a grinding head equipped with a grinding wheel and operates in the following manner. Namely, the grinding head is moved along a previously programmed outer profile of a glass sheet placed on an X-Y coordinate plane by means of a numerical control system and is orbited angularly around an axis or a vertical axis perpendicular to the X-Y coordinate plane during the movement along the outer profile so that a rotation axis of the grinding wheel is moved and positioned in the direction normal to the profile line of the glass sheet and the circumferential edge of the grinding wheel is brought into contact with the peripheral edge of the glass sheet. The apparatus is a type of an air float in which the grinding wheel is pressed against the peripheral edge of the glass sheet by means of an air cylinder disposed on the grinding head.

Particularly, the seaming is generally performed with the apparatus of the type of an air float in such a way that the grinding wheel is elastically supported under air pressure force developed by an air cylinder and softly contacts the peripheral edge of the glass sheet so that a delicate and fine grinding, for instance, the seaming can be achieved. If the air pressure exerted on the air cylinder is increased, the grinding wheel is strongly pressed against a peripheral portion of the glass sheet so that it can be completely ground. Since the grinding wheel elastically contacts the glass sheet under the air pressure force, it is effectively prevented to cause a failed or incomplete grinding of the glass sheet.

However, the grinding apparatus which is of the air-floating type and numerically controllable as mentioned above, has the following disadvantages.

Namely, the grinding head of the grinding apparatus composed of the grinding wheel which directly performs the grinding of the glass sheet, the spindle for the grinding wheel, and other parts which are mounted thereon, is supported movably by a weak elastic force based on the air pressure. Therefore, when the grinding head is subjected to an excessive angular-control at the round corner portion of the glass sheet, the grinding head including the grinding wheel are deviated outward or vibrated by a centrifugal force so that the glass sheet is undesirably ground to generate deformation or distortion in its configuration and dimension. The distortion or deformation generated at the corner portion of the glass sheet is increased by an increase of working speed and a drastic angular-control of the grinding wheel, resulting in yield reduction of the products.

SUMMARY OF THE INVENTION

Accordingly, it is an object of the present invention to provide an apparatus for grinding a glass sheet which eliminates the aforementioned disadvantages due to the centrifugal force generated when a working or grinding head of the grinding apparatus is subjected to excessive angular-control, while keeping such an essential advantage which is accompanied by the grinding apparatus of air-floating type, that the seaming operation is accurately achieved.

The grinding apparatus according to the invention comprises a base member, a sliding portion slidably mounted on the base member, the sliding portion including working wheel and a spindle on which the working wheel is mounted, supporting means provided on the base member for elastically supporting the sliding portion on the base member when the sliding portion is not influenced by the excessive centrifugal force and rigidly supporting the sliding portion on the base member when an excessive centrifugal force is exerted on the sliding portion due to a drastic angular-control.

Other aspects and advantages of the invention will become apparent from the following detailed description and the accompanying drawings illustrating by way of example the features of the invention.

PREFERRED EMBODIMENTS OF THE INVENTION

Figure 1:
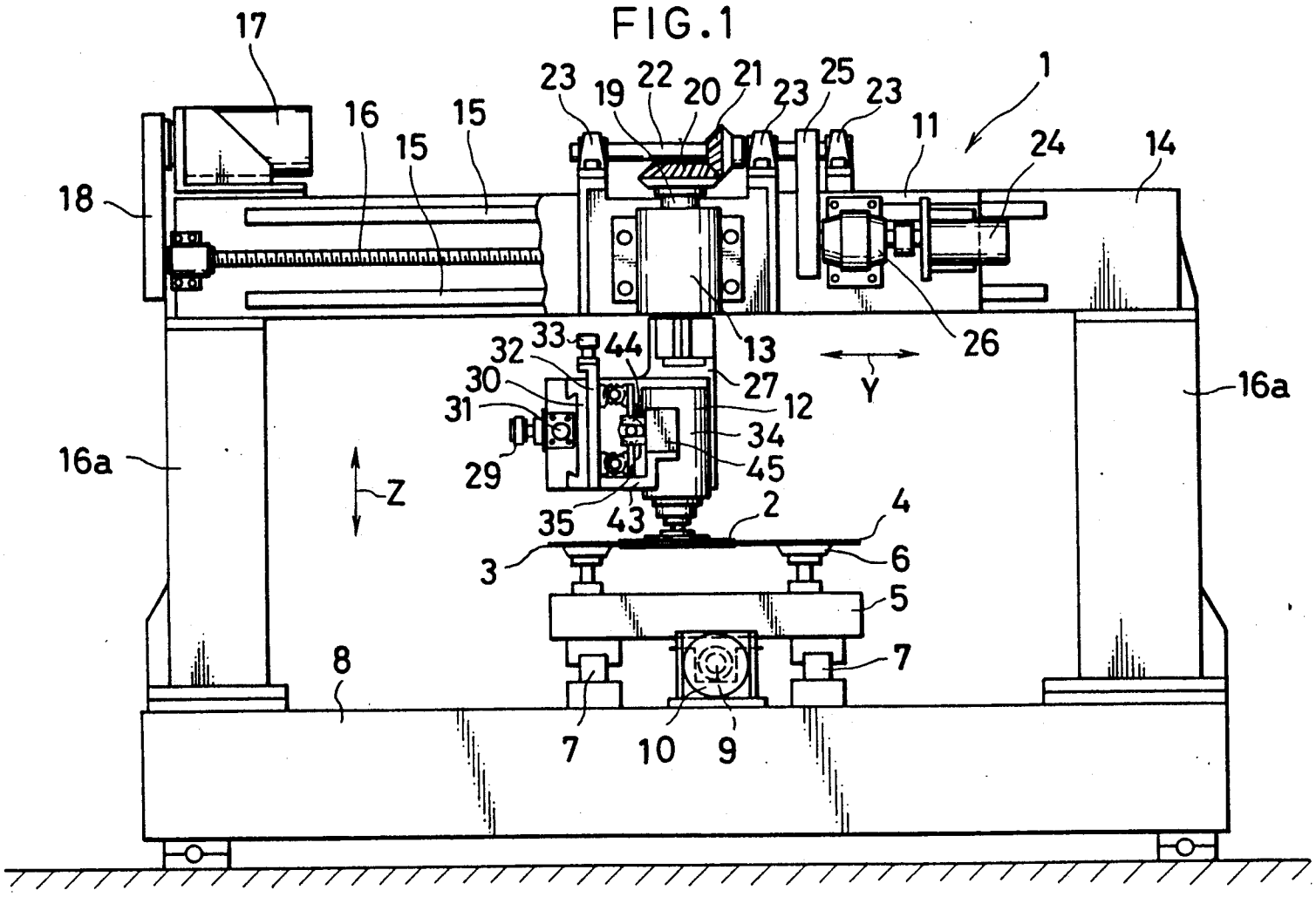
FIG. 1 is a front view of an apparatus for grinding a glass sheet according to the invention.
Figure 2:
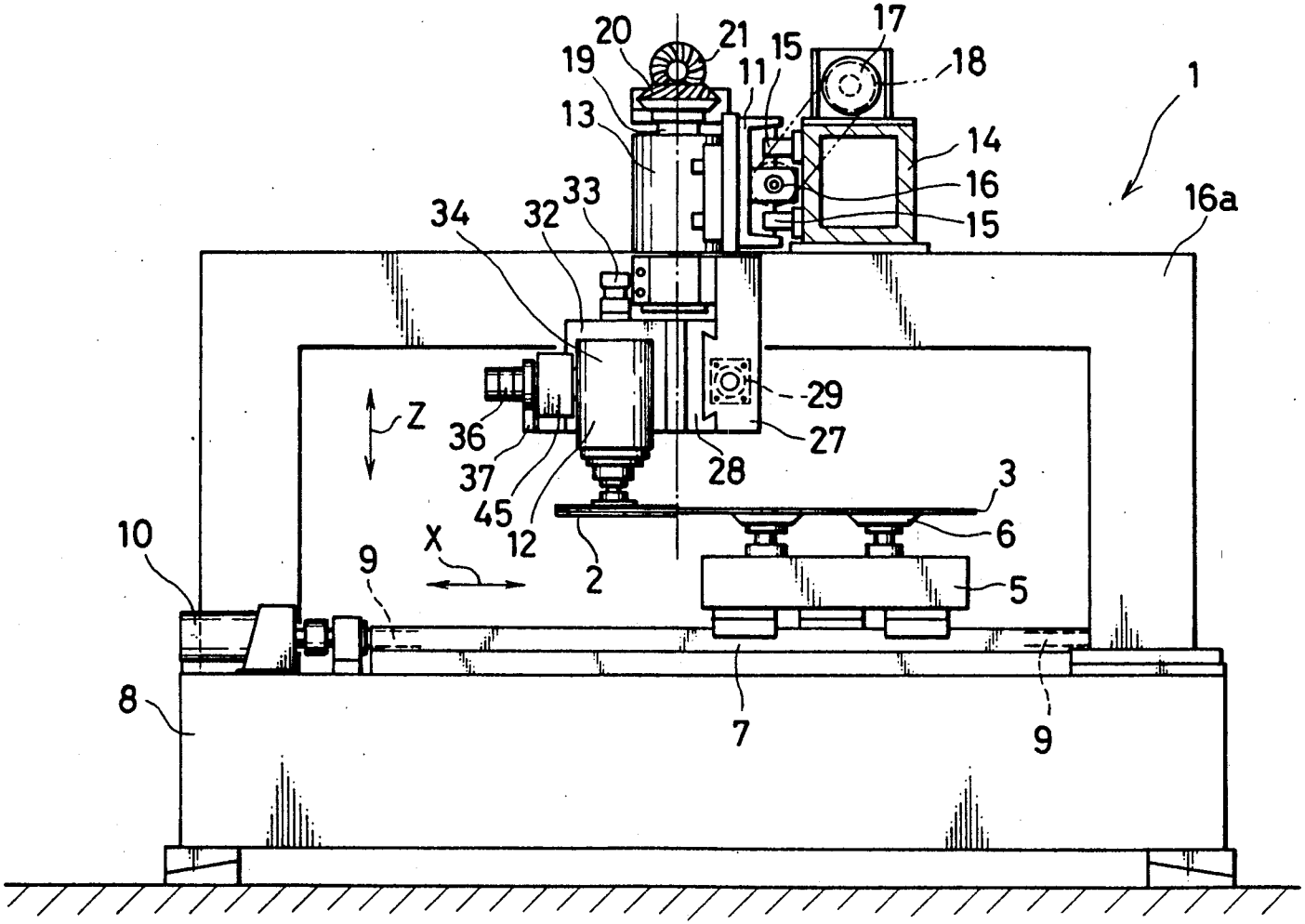
FIG. 2 is a side elevation view of the grinding apparatus according to the invention.
Figure 3:
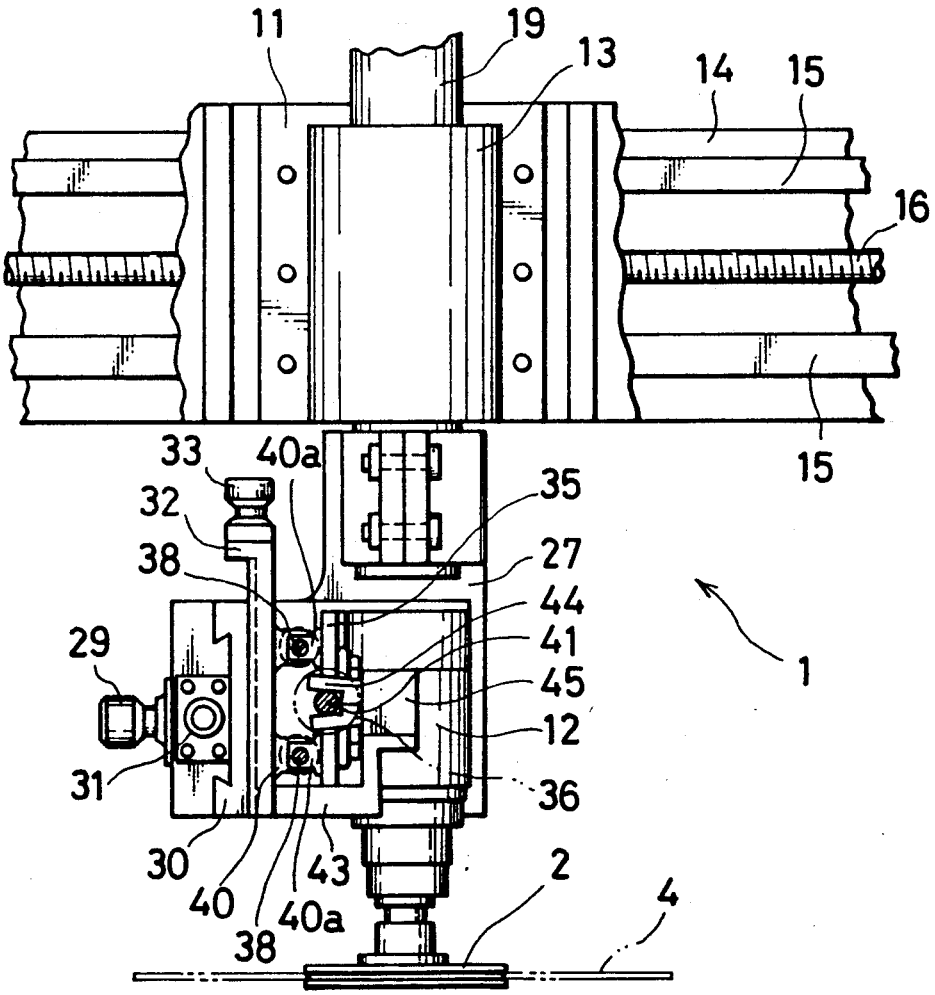
FIG. 3 is a fragmentary front view on an enlarged scale illustrating a grinding head of the grinding apparatus according to the invention.
Figure 4:
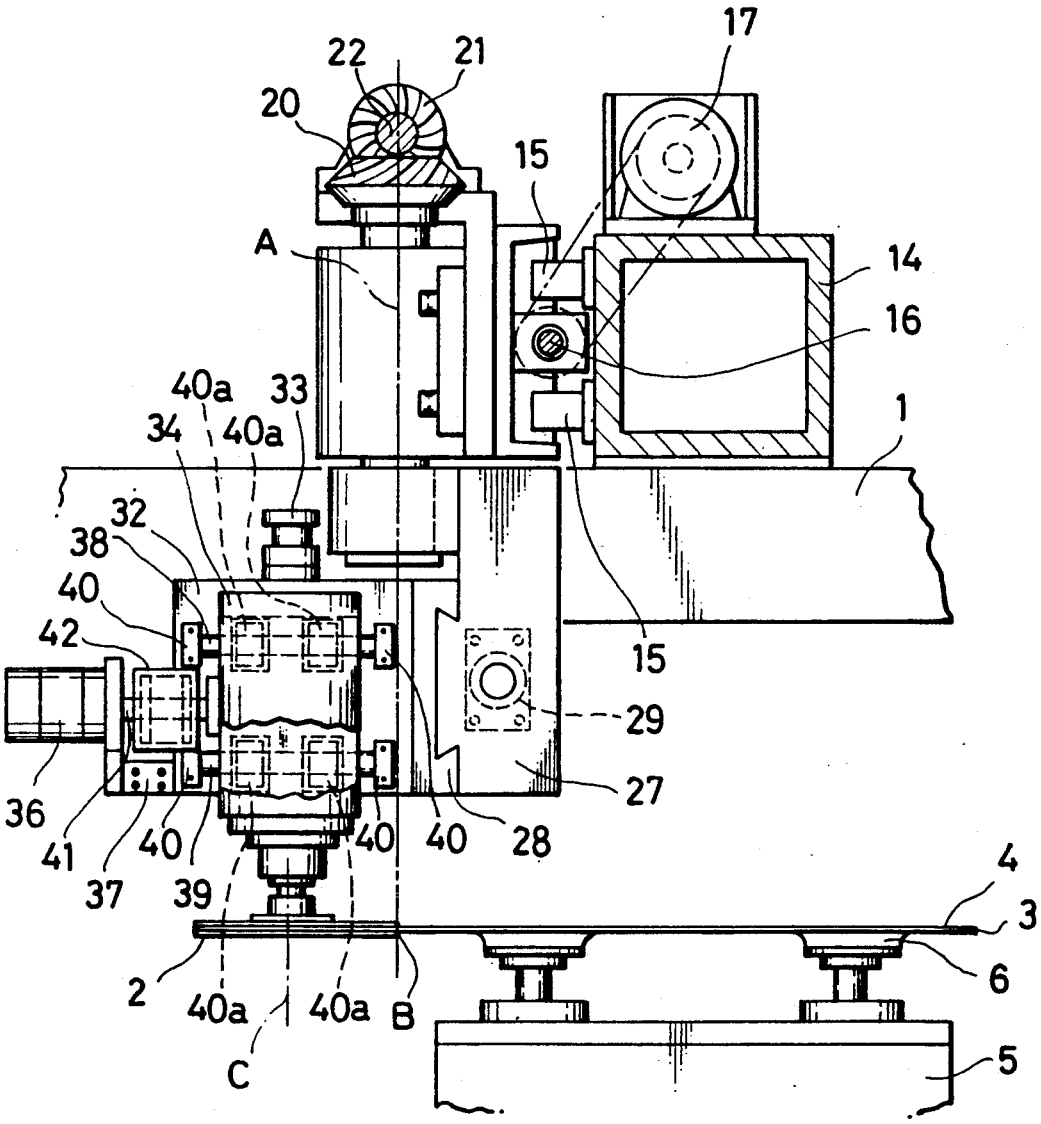
FIG. 4 is a fragmentary side elevation view on an enlarged scale illustrating the grinding head of the grinding apparatus according to the invention.
Figure 5:
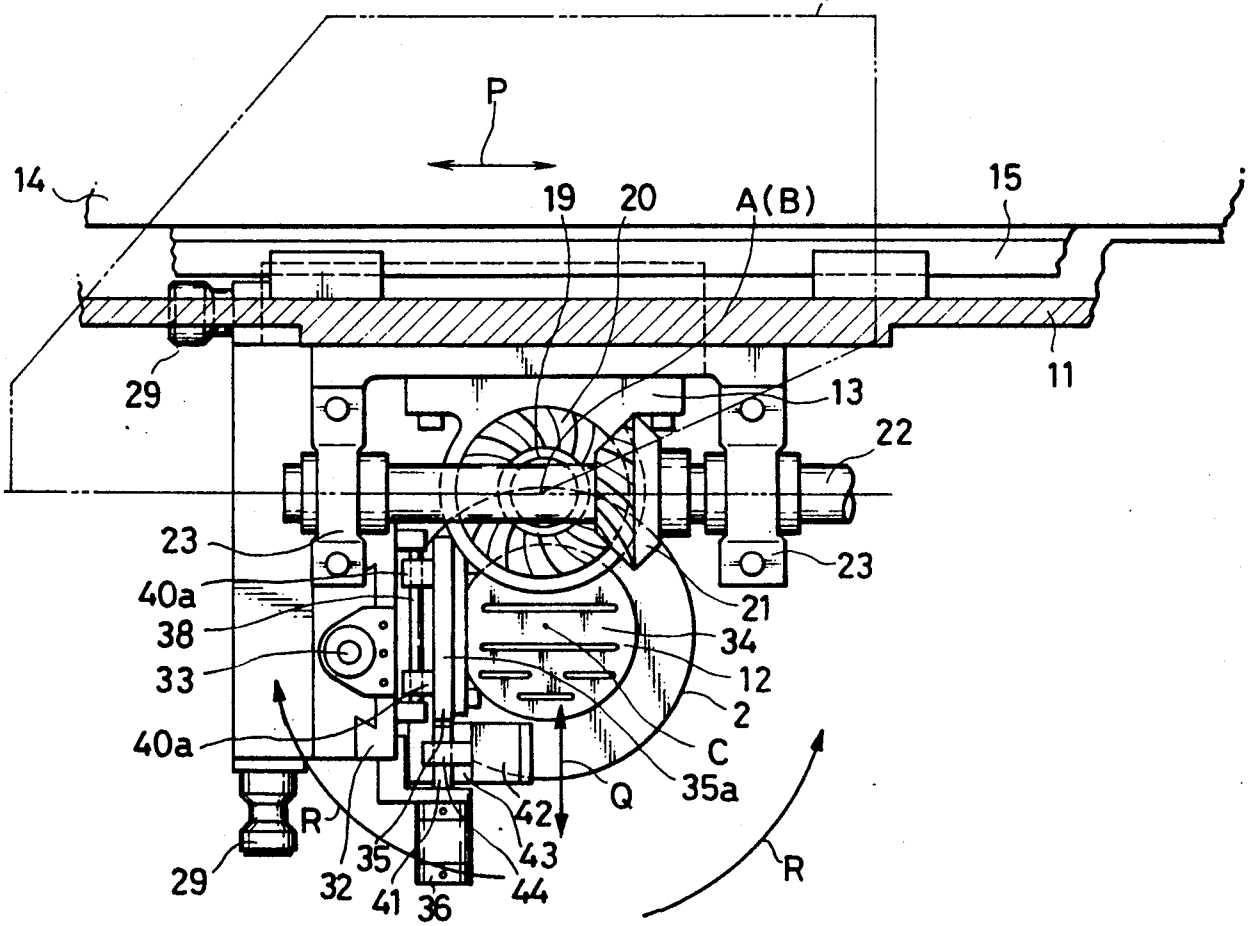
FIG. 5 is a fragmentary plan view on an enlarged scale illustrating the grinding head of the grinding apparatus according to the invention upon a grinding operation.
Figure 6:
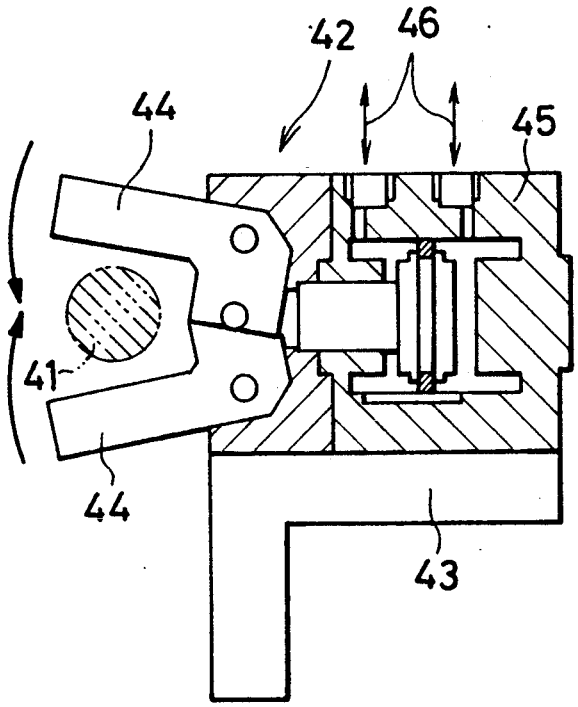
FIG. 6 is a fragmental cross sectional view on an enlarged scale illustrating a brake device of the grinding apparatus according to the invention.

In FIGS. 1 to 6, a grinding apparatus 1 has a working or grinding wheel 2 which is controlled by a numerical control device (not shown) based on a numerical command thereof to grind an edge 3 of a glass sheet or plate 4.

In the grinding apparatus 1, a table 5 on which the glass sheet 4 is horizontally placed and fixed by means of an air suction device 6, is slidably supported in the direction of the axis X by a X-axis sliding device 7 mounted on a bed 8 and is connected to a X-axis feed screw 9 which is connected to a X-axis servo motor 10, whereby the tables 5 is rectilinearly moved on the sliding device 7 in the direction of the axis X so that the glass sheet 4 is also rectilinearly moved in the direction of the axis X when the motor 10 is driven by means of the numerical control device and then the screw 9 is rotated on the grinding operation.

A head carriage 11 from which a working or grinding head 12 is suspended through a bearing device 13 is mounted slidably in the direction of the axis Y on a frame 14 by means of a Y-axis sliding device 15 apart from the table 5 in an upper portion of the apparatus 1, the axis Y extending perpendicular to the direction X, the frame 14 being mounted on side frames 16a which are provided on the side end of the bed 8. The carriage 11 is connected to a Y-axis feed screw 16 which is connected to an output shaft of a Y-axis servo motor 17 by means of a belt 18, whereby the carriage 11 is rectilinearly moved on the sliding device 15 in the direction of the axis Y so that the head 12 is also rectilinearly moved in the direction of the axis Y when the motor 17 is driven by means of the numerical control device and then the screw 16 is rotated by means of the belt 18 on the grinding operation.

The bearing device 13 mounted on the head carriage 11 rotatably supports a orbiting shaft 19 extending in the vertical direction or along an axis Z which is perpendicular to the directions of the axes X and Y. The grinding head 12 is suspended from the lower portion of the shaft 19 which is provided with a bevel gear 20 at an upper portion thereof. The gear 20 engages with a bevel gear 21 having a shaft 22 which is supported rotatably by bearings 23 fixed on the carriage 11. The shaft 22 is connected to an output shaft of a servo motor 24 through a belt 25 and a reduction gear 26. The orbiting shaft 19 is disposed perpendicular to a plane surface of the glass sheet 4 which is placed on the table 5 and defines the X-Y coordinate plane.

The grinding head 12 includes a base member 27 which is connected fixedly to the shaft 19 at the upper portion thereof, a first sliding device 28 connected slidably to the base member 27 for adjusting the initial position of the wheel 2 in direction P parallel to the plane X-Y by means of the rotation of a knob 29 with a screw, a second sliding device 30 connected slidably to the device 28 for adjusting the initial position of the wheel 2 in direction Q perpendicular to the direction P and parallel to the plane X-Y by means of the rotation of a knob 31 with a screw, and a third sliding device 32 connected slidably to the device 30 for adjusting the initial position of the wheel 2 in direction Z by means of the rotation of a knob 33 with a screw.

The grinding head 12 further includes a spindle motor device 34 mounted on the device 32 slidably in the direction Q through a slider 35, the motor device 34 being provided on the lower end of the spindle thereof with the wheel 2 which has a groove on a peripheral edge thereof, and an air cylinder 36 mounted on the device 32 by means of a supporting member 37.

The motor device 34 has both functions of a spindle and a motor for driving the spindle.

The slider 35 comprises a base plate 35a on which the motor device 34 is fixedly mounted, a pair of shafts 38 and 39 extending parallel to each other and along the direction Q and supported fixedly on the device 32 through supporting members 40 at the ends thereof, and slide bearings 40a fixed to the plate 35a and slidably connected to the shafts 38 and 39. A ball sliding bearing may be generally used as the bearings 40a so as to be able to move motor device 34 in the direction Q by only a small air pressure force developed by means of the air cylinder 36.

The air cylinder 36 has a connecting rod 41 which is connected at the end of thereof to the plate 35a on which the motor device 34 is mounted, thereby the motor device 34 is supported in air-floating manner in the direction Q with respect to the slide device 32 and therefore the base member 27. An air cylinder, especially a low friction air cylinder, preferably bellow-diaphragm type cylinder produced by Fujikura Rubber Limited may be used as the air cylinder 36.

When the motor 24 is driven by means of the numerical control device and then the gear 21 is rotated through the gear 26, the belt 25 and the shaft 22 so that the gear 20 is also rotated around a center axis A which extends along the direction Z and through a working point B where the peripheral edge of the wheel 2 is contacted the peripheral edge 3 of the glass sheet 4 to grind the edge 3 of the sheet 4, the head 12 and therefore the motor device 34 is orbited around the center axis A in the direction R, thereby the wheel 2 is also orbited around the center axis A. Further, when the motor device 34 is driven by means of the numerical control device, the wheel 2 is rotated around a rotation center axis C thereof to grind the peripheral edge 3 of the glass sheet 4 at the working point B during the grinding operation. The motor device 34 and therefore the grinding wheel 2 are supported by the air cylinder 36 movably and is pressed against the peripheral edge 3 of the sheet 4 in the direction Q normal to the peripheral profile of the glass sheet 4 at the working point B during the grinding operation.

A brake device 42 is fixedly mounted on the slider 32 through a bracket 43 at the position between the spindle motor device 34 and the air cylinder 36 which air-floatingly supports the device 34 with respect to the direction Q. The brake device 42 includes chuck claws 44 for chucking the rod 41 at a closed position thereof to prevent the rod 41 to move in the direction Q and to them fix the motor device 34 to the slider 32, and a fluid actuator, for instance, air cylinder 45 for actuating the claws 44 by means of an air pressure to set the claws 44 at the opened and closed positions, and an air valve (not shown) for controlling a supplying of the air 46 to the cylinder 45 by means of the numerical control device.

When the chuck claws 44 is set to the opened position and the rod 41 is released from the chucked state, the slider 35 and the spindle motor device 34 fitted with the grinding wheel 2 are air-floatingly supported through the coupling rod 41 by the air cylinder 36 in the direction Q. When the chuck claws 44 is set to the closed position and chucks the rod 41, the slider 35 and the spindle motor device 34 is locked in the slider 32 and is therefore supported rigidly on the device 32 so that the grinding wheel 2 pressed rigidly against the edge 3 of the sheet 4 at the point B performs the grinding or seaming operation without influence of air-floating movement.

The apparatus 1 of the invention performs the seaming operation of the glass sheet 4 as follows. The grinding wheel 2 is moved along the programmed profile of the glass sheet 4 placed on the table 5. The grinding wheel 2 is controlled angularly around the axis A to position the rotation center C of the wheel 2 in the direction normal to the profile of the peripheral edge 3 of the sheet 4 at the working point B while being air-floatingly supported by means of the air cylinder 36. When a large centrifugal force is exerted on the motor device 34 due to an excessive angular-control conducted at the round corner portion of the glass sheet 4 to be ground, the numerical control device controls such that the brake device 42 locks an air-floating movement of the motor device 34 with the wheel 2. On the other hand, in other peripheral portions where the excessive angular-control is not conducted and the large centrifugal force is not exerted on the motor device 34, the locking operation of the brake device 42 is released so that the grinding wheel 2 grinds the edge 3 of the glass sheet 4 under soft air-elastic force.

As is apparent from the aforementioned preferred embodiment, the apparatus 1 according to the invention enables the peripheral edge 3 of the glass sheet 4 to be accurately ground along the programmed profile including a round corner, resulting in achievement of a seaming operation at both the round corner and other straight-line peripheral portions without any curvature.

What is claimed is:

1. An apparatus for working a glass member, which comprises:

a working tool for working the glass member, positioning means for relatively moving the tool and the glass member in a first direction and a second direction perpendicular to the first direction to position a working portion of the working tool at a portion of the glass member to be worked, orbiting means connected to the tool for orbiting the tool around an axis perpendicular to a plane defined by the first and second direction, said axis extending through a working point where the working portion of the working tool contacts with the portion of the glass member to be worked, supporting means connected to the tool for elastically supporting the tool so that the tool is elastically movable in a third direction normal to a profile of the glass member at the working point, inhibiting means for inhibiting an elastically supporting action of the supporting means to rigidly support the tool in said third direction when a working operation is in a predetermined state.

2. An apparatus for grinding a glass member, comprising:

supporting means for supporting said glass member, grinding means for grinding said glass member, moving means for relatively moving the supporting means and grinding means in a first direction and a second direction perpendicular to the first direction, orbiting means connected to the grinding means for orbiting the grinding means around an axis perpendicular to a plane defined by the first and second directions, said axis extending through a working point where the grinding means contacts with the glass member to grind the glass member, pressing means connected to the grinding means for elastically and rigidly pressing the grinding means against the glass member in a third direction normal to a profile of the glass member at the working point, and control means connected to the pressing means for controlling the pressing means to press rigidly the grinding means against the glass member when a grinding operation is a first state and to press elastically the grinding means against the glass member in said third direction when the grinding operation is a second state.

3. An apparatus according the claim 2, wherein said pressing means comprises:

means for elastically supporting the grinding means to elastically press the grinding means against the glass member, and means for releasing the second state where the grinding means is elastically supported by said elastically supporting means to rigidly press the grinding means against the glass member.

4. An apparatus according to the claim 3, wherein said elastically supporting means comprises:

an air cylinder means connected to the grinding means for supporting the grinding means in an air floating manner, and sliding means connected to the grinding means for slidably supporting the grinding means, and, wherein said releasing means comprises chuck means connectable to said cylinder means for chucking said cylinder means when the grinding operation is the first state, and actuating means for actuating said chuck means.

* * * * *